US009963656B2

(12) United States Patent
Woodward et al.

(10) Patent No.: US 9,963,656 B2
(45) **Date of Patent: *May 8, 2018**

(54) LUBRICATING OIL COMPOSITIONS

(75) Inventors: Philip J. Woodward, Reading (GB); Wangkan Lin, Bridgewater, NJ (US); Erika M. Vela, Westfield, NJ (US); Anthony J. Strong, Oxford (GB)

(73) Assignee: INFINEUM INTERNATIONAL LIMITED (GB)

( * ) Notice: Subject to any disclaimer, the term of this patent is extended or adjusted under 35 U.S.C. 154(b) by 0 days. days.

This patent is subject to a terminal disclaimer.

(21) Appl. No.: 13/445,286

(22) Filed: Apr. 12, 2012

(65) Prior Publication Data

US 2013/0274158 A1 Oct. 17, 2013

(51) Int. Cl.

| | |
|---|---|
| ***C10M 169/04*** | (2006.01) |
| ***C10M 129/02*** | (2006.01) |
| ***C01G 39/06*** | (2006.01) |
| ***C10M 137/10*** | (2006.01) |
| ***C10M 125/22*** | (2006.01) |
| ***C10M 135/00*** | (2006.01) |
| ***C10M 135/18*** | (2006.01) |
| ***C10M 161/00*** | (2006.01) |

(52) U.S. Cl.

CPC ..... *C10M 137/10* (2013.01); *C10M 125/22* (2013.01); *C10M 135/00* (2013.01); *C10M 135/18* (2013.01); *C10M 161/00* (2013.01); *C10M 2203/1006* (2013.01); *C10M 2205/026* (2013.01); *C10M 2209/11* (2013.01); *C10M 2219/068* (2013.01); *C10M 2227/066* (2013.01); *C10N 2230/06* (2013.01); *C10N 2230/42* (2013.01); *C10N 2230/45* (2013.01); *C10N 2240/10* (2013.01)

(58) Field of Classification Search

CPC ..... C10M 2201/066; C10M 2205/022; C10N 2230/02; C10N 2220/02

USPC ..... 508/167, 591

See application file for complete search history.

(56) References Cited

U.S. PATENT DOCUMENTS

| | | | | |
|---|---|---|---|---|
| 4,164,473 | A | 8/1979 | Coupland et al. | |
| 4,176,073 | A | 11/1979 | Ryer et al. | |
| 4,176,074 | A | 11/1979 | Coupland et al. | |
| 4,192,757 | A | 3/1980 | Brewster | |
| 4,201,683 | A | 5/1980 | Brewster | |
| 4,248,720 | A | 2/1981 | Coupland et al. | |
| 4,289,635 | A | 9/1981 | Schroeck | |
| 4,479,883 | A | 10/1984 | Shaub et al. | |
| 6,423,671 | B1 | 7/2002 | Haruna | |
| 2006/0068999 | A1* | 3/2006 | Shaw et al. | 508/287 |

FOREIGN PATENT DOCUMENTS

| | | | |
|---|---|---|---|
| EP | 1209220 | A1 | 5/2002 |
| WO | WO-200071649 | A1 | 11/2000 |
| WO | WO-2006089799 | A1 | 8/2006 |
| WO | WO-2011107739 | A1 | 9/2011 |

* cited by examiner

*Primary Examiner* — Vishal Vasisth

(57) ABSTRACT

An internal combustion engine crankcase lubricating oil composition having a sulphated ash content of no greater than 1.2 mass %, based on the mass of the lubricating oil composition, and a phosphorous content of no greater than 0.1 mass %, based on the mass of the lubricating oil composition, which lubricating oil composition comprises or is made by admixing:

(A) a crankcase base oil of lubricating viscosity, in a major amount; and (B) the following additives, in respective minor amounts:

(B1) a polymeric friction modifier being the reaction product of (a) a functionalized polyolefin, (b) a polyether, (c) a polyol, and (d) a monocarboxylic acid chain terminating group; and (B2) at least one oil-soluble molybdenum compound.

10 Claims, No Drawings

LUBRICATING OIL COMPOSITIONS

This invention relates to internal combustion engine crankcase lubricating oil compositions, in particular those with improved friction characteristics.

BACKGROUND OF THE INVENTION

Internal combustion engines are lubricated by circulating lubricating oil (or crankcase lubricant) from an oil sump generally situated below the crankshaft of the engine. To reduce the energy and fuel requirements of the engine, there is a need for crankcase lubricants that reduce the overall friction of the engine. Reducing friction losses in an engine contributes significantly to improving fuel economy.

It has long been known to use combinations of friction modifiers to obtain improved friction performance. However, conventional friction modifiers often have detrimental effects on other aspects such as lubricant stability.

A recent example of a friction reducing additive for use in automotive engine oil and/or fuel is described in International patent application No. WO 2011/107739. The friction reducing additives described in this document are the reaction product of a hydrophobic polymeric subunit selected from polyolefins, polyacrylics and polystyrenyls and a hydrophilic polymeric sub unit selected from polyethers, polyesters and polyamides. The friction reducing additives described in WO 2011/107739 are said to facilitate improved fuel economy and fuel economy retention performance in an engine oil or fuel.

In addition, oil-soluble molybdenum containing additives are also often used for their friction reducing properties. Examples of patent applications which refer to oil-soluble molybdenum additives for lubricating oil compositions include U.S. Pat. Nos. 4,164,473; 4,176,073; 4,176,074; 4,192,757; 4,248,720; 4,201,683; 4,289,635 and 4,479,883.

In particular, International patent application No. WO 00/71649 discloses use of oil-soluble molybdenum compounds at levels providing from 10-350 ppm molybdenum to the lubricating oil. When used in combination with a particular zinc dialkyldithiophosphate, a particular base stock composition and a supplementary friction modifier, it is said that enhanced fuel economy and fuel economy retention can be obtained, despite the relatively low amount of molybdenum present in the lubricating oil composition.

U.S. Pat. No. 6,423,671 ('671) relates to lubricating compositions with improved frictional characteristics which translates into improved fuel economy when the compositions are used in internal combustion engines. In particular, '671 relates to lubricant compositions containing organo-molybdenum compounds together with zinc salts, metal-containing detergents and ashless friction modifiers (referred to as surfactants). '671 states that molybdenum compounds can improve frictional characteristics but that their effect is not fully realised in the above particular compositions because of preferred absorption on moving surfaces of the non-molybdenum polar components. This competition for absorption of polar components results, for example, in a tendency for detergents to be absorbed more readily then molybdenum compounds.

'671 meets the above problem by using dispersants to form a first semi-package with the above-mentioned non-molybdenum polar components, the semi-package being made by mixing and heating the components, for example at about 90° C. for about 1-3 hours. The molybdenum component is provided in a second semi-package, and the first and second semi-packages added to an oil of lubricating viscosity.

A problem with the approach described in '671 in that it requires additional processing steps, particularly the preparation of the first semi-package. The problem of competition for absorption has also been addressed in a different way in International patent application No. WO 06/89799 by employing a detergent system of low metal ratio in a lubricating oil composition of low total base number (TBN).

Fuel economy tests are becoming more closely aligned with engine operations and so fuel economy performance is critical in all temperature regimes including the low temperatures present at engine start up.

SUMMARY OF THE INVENTION

In a first aspect, this invention provides an internal combustion engine crankcase lubricating oil composition having a sulphated ash content of no greater than 1.2 mass %, based on the mass of the lubricating oil composition, and a phosphorous content of no greater than 1200 ppm, based on the mass of the lubricating oil composition, which lubricating oil composition comprises or is made by admixing:

(A) a crankcase base oil of lubricating viscosity, in a major amount; and (B) the following additives, in respective minor amounts:

(B1) a polymeric friction modifier being the reaction product of (a) a functionalised polyolefin, (b) a polyether, (c) a polyol, and (d) a monocarboxylic acid chain terminating group (B2) at least one oil-soluble molybdenum compound.

In a second aspect, the present invention provides a method of improving fuel economy performance of a vehicle by lubricating the engine with a lubricating oil according to the first aspect of the present invention.

In a third aspect, the present invention provides a method of improving low temperature fuel economy performance of a vehicle, by lubricating the engine with a lubricating oil according to the first aspect of the present invention.

In a fourth aspect, the present invention provides use of a lubricating oil composition according to the first aspect of the invention to improve fuel economy performance of a vehicle lubricated with that lubricating oil.

In a fifth aspect, the present invention provides use of a lubricating oil composition according to the first aspect of the invention to improve low temperature fuel economy performance of a vehicle lubricated with that lubricating oil.

In this specification, the following words and expressions, if and when used, shall have the meanings ascribed below:

"active ingredient" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means in excess of 50 mass % of a composition;

"minor amount" means less than 50 mass % of a composition;

"TBN" means total base number as measured by ASTM D2896.

Furthermore in this specification:

"phosphorus content" is as measured by ASTM D5185;

"sulphated ash content" is as measured by ASTM D874;

"sulphur content" is as measured by ASTM D2622;

"$KV_{100}$" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to each and all aspects of the invention, will now be described in more detail as follows:

Crankcase Base Oil (A)

The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural (vegetable, animal or mineral) and synthetic lubricating oils and mixtures thereof.

The base stock groups are defined in the American Petroleum Institute (API) publication "Engine Oil Licensing and Certification System", Industry Services Department, Fourteenth Edition, December 1996, Addendum 1, December 1998.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.

b) Group II base stocks contain greater than or equal to 90 percent saturates and less than or equal to 0.03 percent sulphur and have a viscosity index greater than or equal to 80 and less than 120 using the test methods specified in Table E-1.

c) Group III base stocks contain greater than or equal to 90 percent saturates and less than or equal to 0.03 percent sulphur and have a viscosity index greater than or equal to 120 using the test methods specified in Table E-1.

d) Group IV base stocks are polyalphaolefins (PAO).

e) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

It is acknowledged that additives included in the lubricating oil composition may comprise carrier oil, which carrier oil is not considered part of the base stock for calculating the composition of the base stock.

Examples of oils of lubricating viscosity which may be included in the lubricating oil composition are detailed as follows.

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Preferably, the volatility of the oil of lubricating viscosity, as measured by the Noack test (ASTM D5880), is less than or equal to 20%, preferably less than or equal to 16%, preferably less than or equal to 12%, more preferably less than or equal to 10%.

Whilst the composition of the base oil will depend upon the particular application of the lubricating oil composition and the oil formulator will chose the base oil to achieve desired performance characteristics at reasonable cost, the base oil of a lubricating oil composition according to the present invention comprises no more than 85 mass % Group IV base oil.

The oil of lubricating viscosity is provided in a major amount and in combination with a minor amount of the additives (B1 and (B2) and, if necessary, one or more co-additives such as described hereinafter, constitutes the lubricating oil composition of the present invention. Preparation of the lubricating oil composition may be accomplished by adding the additive directly to the oil or by adding it in the form of a concentrate thereof to disperse or dissolve the additive. Additives may be added to the oil by any method known to those skilled in the art, either prior to, contemporaneously with, or subsequent to, addition of other additives.

The terms "oil-soluble" or "dispersible", or cognate terms, used herein do not necessarily indicate that the compounds or additives are soluble, dissolvable, miscible, or are capable or being suspended in the oil in all proportions. They do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Polymeric Friction Modifiers (B1)

As with all polymers, the polymeric friction modifier of the present invention will comprise a mixture of molecules of various sizes. Suitably, the majority of the molecules have a molecular weight in the range of 1,000 to 30,000 Daltons.

The functionalised polyolefin is preferably derived from a polymer of a monoolefin having from 2 to 6 carbon atoms, such as ethylene, propylene, butane and isobutene. The functionalised polyolefin of the present invention suitably contains a chain of from 15 to 500, preferably 50 to 200 carbon atoms. Preferably, the polymer of the first polymeric sub unit is polyisobutene or a derivative thereof.

The functionalised polyolefin may comprise a diacid or anhydride functional group from reaction of the polyolefin with an unsaturated diacid of anhydride. The functionalised polyolefin is suitably functionalised by reaction with maleic anhydride.

In a preferred embodiment, the functionalised polyolefin is a polyisobutylene polymer that has been reacted with maleic anhydride to form polyisobutylene succinic anhydride (PIBSA). Suitably, the PIBSA has a molecular weight in the range of 300-5000 Da, preferably 500-1500 Da and especially 800 to 1200 Da. PIBSA is a commercially available compound made from the addition reaction of polyisobutylene having a terminal unsaturated group and maleic anhydride.

Alternatively, the functionalised polyolefin may be functionalised by an epoxidation reaction with a peracid, for example perbenzoic acid or peracetic acid.

The polyether may comprise, for example, polyglycerol or polyalkylene glycol. In a preferred embodiment the polyether is a water soluble alkylene glycol, such as polyethylene glycol (PEG). Suitably the PEG has a molecular weight in the range of 300-5000 Da, more preferably 400-1000 Da and particularly 400 to 800 Da. In a preferred embodiment the polyether is $PEG_{400}$, $PEG_{600}$ or $PEG_{1000}$. Alternatively, a mixed poly(ethylene-propylene) glycol or a mixed poly(ethylene-butylene) glycol may be used. Alternatively, the polyether may be derived from a diol or a diamine containing acidic groups, for example, carboxylic acid groups, sulphonyl groups (e.g. sulphonyl styrenic groups), amine groups (e.g. tetraethylene pentamine or polyethylene imine) or hydroxyl groups.

The polyether suitably has a molecular weight of 300-5,000 Da, more preferably 400-1,000 Da or 400-800 Da.

The functionalised polyolefin and the polyether of the present invention may form block copolymer units.

The functionalised polyolefin and the polyether may be linked directly to one another and/or they may be linked together by a backbone moiety.

The polyol reactant of the polymeric friction modifier of the present invention suitably provides a backbone moiety capable of linking together the functionalised polyolefin and polyether reactants. The polyol may be a diol, triol, tetrol, and/or related dimers or trimers or chain extended polymers of such compounds. Suitable polyols include glycerol, neopentyl glycol, trimethylolethane, trimethylolpropane, trimethylolbutane, pentaerythritol, dipentaerythritol, tripentaerythritol and sorbitol. In a preferred embodiment the friction modifier comprises a glycerol backbone moiety.

The polymeric friction modifier of the present invention comprises monocarboxylic acid chain terminating group. Any carboxylic acid would be a suitable chain terminating group. Suitable examples include $C_{2-36}$ carboxylic acids, preferably $C_{6-30}$ carboxylic acids and more preferably, $C_{12-22}$ carboxylic acids. The carboxylic acids may be linear saturated, branched saturated, linear unsaturated and branched unsaturated acids. In preferred embodiments the carboxylic acid chain terminating group is chosen from the group comprising lauric acid, erucic acid, isostearic acid, palmitic acid, oleic acid and linoleic acid. In preferred embodiments the carboxylic acid chain terminating group is fatty carboxylic acid, and a particularly preferred fatty acid is tall oil fatty acid, which is primarily oleic acid.

The friction modifier (B1) suitably has an average molecular weight of from 1,000 to 30,000 Da, preferably from 1,500 to 25,000, more preferably from 2,000 to 20,000 Da.

The friction modifier (B1) suitably has an acid value of less than 20, preferably less than 15 and more preferably less than 10. The friction modifier (B1) suitably has an acid value of greater than 1, preferably greater than 3 and more preferably greater than 5. In a preferred embodiment, the friction modifier (B1) has an acid value in the range of 6 to 9.

Suitably, the friction modifier (B1) is as described in International Patent Application no WO 2011/107739, and the description and examples of the method of making the friction modifier therein is incorporated herein by reference thereto.

In a preferred embodiment the friction modifier (B1) is a reaction product of maleinised polyisobutylene, PEG, glycerol and tall oil fatty acid, wherein the polyisobutylene of the maleinised polyisobutylene has an average molecular weight of around 950 amu, and an approximate saponification value of 98 mg KOH/g and the PEG has a hydroxyl value of 190 mg KOH/g. A suitable additive may be made by charging 110 g of maleinised polyisobutylene, 72 g of PEG, 5 g of glycerol and 25 g of tall oil fatty acid into a glass round bottomed flask equipped with a mechanical stirrer, isomantle heater and overhead condenser. The reaction takes place in the presence of 0.1 g of esterification catalyst terabutyl titanate at 200-220° C., with removal of water to a final acid value of 10 mg KOH/g.

The polymeric friction modifier of the present invention is suitably present in the lubricating oils composition, on an active matter basis, in an amount of at least 0.1, preferably at least 0.2 mass %, based on the mass of the lubricating oil composition. The polymeric friction modifier of the present invention is suitably present in the lubricating oils composition, on an active matter basis, in an amount of less than 5 mass %, preferably less than 3 mass % and more preferably, less than 1.5 mass %, based on the mass of the lubricating oil composition.

Oil-Soluble Molybdenum Compound (B2)

For the lubricating oil compositions of this invention, any suitable oil-soluble organo-molybdenum compound having friction modifying properties in lubricating oil compositions may be employed. As examples of such oil-soluble organo-molybdenum compounds, there may be mentioned dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

The molybdenum compound may be mono-, di-, tri- or tetra-nuclear. Dinuclear and trinuclear molybdenum compounds are preferred, especially preferred are trinuclear molybdenum compounds. The molybdenum compound is preferably an organo-molybdenum compound. More preferably, the molybdenum compound is selected from the group consisting of molybdenum dithiocarbamates (MoDTC), molybdenum dithiophosphates, molybdenum dithiophosphinates, molybdenum xanthates, molybdenum thioxanthates, molybdenum sulfides and mixtures thereof. Most preferably, the molybdenum compound is present as a molybdenum dithiocarbamate compound.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions of the present invention can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Among the molybdenum compounds useful in the compositions of this invention are organo-molybdenum compounds of the formulae $Mo(ROCS_2)_4$ and $Mo(RSCS_2)_4$, wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

One class of preferred organo-molybdenum compounds useful in the lubricating compositions of this invention are trinuclear molybdenum compounds, especially those of the formula $Mo_3S_kL_nQ_z$ and mixtures thereof wherein L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of:

1

2

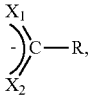

3

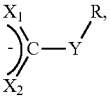

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).

3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ to have cationic cores surrounded by anionic ligands and are represented by structures such as

6

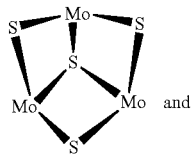

and

7

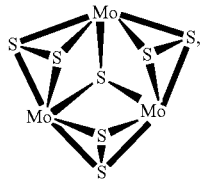

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. This includes the case of a multidentate ligand having multiple connections to a single core. It is believed that oxygen and/or selenium may be substituted for sulfur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur abstracting agent such as cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. In the compounds of the present invention, at least 21 total carbon atoms should be present among all the ligands' organo groups. Preferably, the ligand source chosen has a sufficient number of carbon atoms in its organo groups to render the compound soluble or dispersible in the lubricating composition.

The lubricating oil compositions of the present invention may contain the molybdenum compound in an amount providing the composition with at least 10 ppm, preferably at least 20 ppm and more preferably at least 40 ppm or molybdenum, based on atoms of molybdenum, in the total mass of the lubricating oil composition. The lubricating oil compositions of the present invention may contain the molybdenum compound in an amount providing the composition with no more than 1000 ppm, preferably no more than 700 ppm and more preferably no more than 500 ppm of molybdenum, based on atoms of molybdenum, in the total mass of the lubricating oil composition. Preferred embodiments of the present invention contain the molybdenum compound in an amount providing the composition with from 10 to 1000, more preferably from 10 to 700, still more preferably from 10 to 500, ppm by mass of molybdenum, based on atoms of molybdenum, in the total mass of the lubricating oil composition.

Other Additives

Other additives, such as the following, may also be present in lubricating oil compositions of the present invention.

Metal detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 or greater, and typically will have a TBN of from 250 to 450 or more. In the presence of the compounds of Formula I, the amount of overbased detergent can be reduced, or detergents having reduced levels of overbasing (e.g., detergents having a TBN of 100 to 200), or neutral detergents can be employed, resulting in a corresponding reduction in the SASH content of the lubricating oil composition without a reduction in the performance thereof.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Combinations of detergents, whether overbased or neutral or both, may be used.

In one embodiment of the present invention, the lubricating oil composition includes metal detergents that are chosen from neutral or overbased calcium sulfonates having TBN of from 20 to 450 TBN, and neutral and overbased calcium phenates and sulfurized phenates having TBN of from 50 to 450, and mixtures thereof.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

In another embodiment of the present invention, the lubricating oil composition comprises metal detergents that are neutral or overbased alkali or alkaline earth metal salicylates having a TBN of from 50 to 450, preferably a TBN of 50 to 250, or mixtures thereof. Highly preferred salicylate detergents include alkaline earth metal salicylates, particularly magnesium and calcium, especially, calcium salicylates. In one embodiment of the present invention, alkali or alkaline earth metal salicylate detergents are the sole metal-containing detergent in the lubricating oil composition.

Anti-wear agents reduce friction and excessive wear and are usually based on compounds containing sulfur or phosphorous or both, for example that are capable of depositing polysulfide films on the surfaces involved. Noteworthy are dihydrocarbyl dithiophosphate metal salts wherein the metal may be an alkali or alkaline earth metal, or aluminium, lead, tin, molybdenum, manganese, nickel, copper, or preferably, zinc.

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The preferred zinc dihydrocarbyl dithiophosphates (ZDDP) are oil-soluble salts of dihydrocarbyl dithiophosphoric acids and may be represented by the following formula:

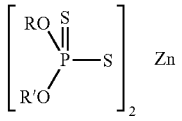

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

The ZDDP is added to the lubricating oil compositions in amounts sufficient to provide no greater than 1200 ppm, preferably no greater than 1000 ppm and more preferably, no greater than 900 ppm phosphorous to the lubricating oil, based upon the total mass of the lubricating oil composition. In a preferred embodiment, the ZDDP is added to the lubricating oil compositions in amounts sufficient to provide no greater than 800 ppm, preferably no greater than 600 ppm phosphorous to the lubricating oil, based upon the total mass of the lubricating oil composition. The ZDDP is suitably added to the lubricating oil compositions in amounts sufficient to provide at least 100 ppm, preferably at least 350 ppm and more preferably, at least 500 ppm phosphorous to the lubricating oil, based upon the total mass of the lubricating oil composition.

Examples of ashless anti-wear agents include 1,2,3-triazoles, benzotriazoles, sulfurised fatty acid esters, and dithiocarbamate derivatives.

Ashless dispersants comprise an oil-soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersants may be, for example, selected from oil-soluble salts, esters, aminoesters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and a polyalkylene polyamine.

Additional Ashless Friction modifiers, such as nitrogen-free organic friction modifiers are useful in the lubricating oil compositions of the present invention and are known generally and include esters formed by reacting carboxylic acids and anhydrides with alkanols. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Examples of other conventional organic friction modifiers are described by M. Belzer in the "Journal of Tribology" (1992), Vol. 114, pp. 675-682 and M. Belzer and S. Jahanmir in "Lubrication Science" (1988), Vol. 1, pp. 3-26.

Preferred organic ashless nitrogen-free friction modifiers are esters or ester-based; a particularly preferred organic ashless nitrogen-free friction modifier is glycerol monooleate (GMO).

Ashless aminic or amine-based friction modifiers may also be used and include oil-soluble alkoxylated mono- and di-amines, which improve boundary layer lubrication. One common class of such metal free, nitrogen-containing friction modifier comprises ethoxylated alkyl amines. They may be in the form of an adduct or reaction product with a boron compound such as a boric oxide, boron halide, metaborate, boric acid or a mono-, di- or tri-alkyl borate. Another metal free, nitrogen-containing friction modifier is an ester formed as the reaction product of (i) a tertiary amine of the formula $R_1R_2R_3N$ wherein $R_1$, $R_2$ and $R_3$ represent aliphatic hydrocarbyl, preferably alkyl, groups having 1 to 6 carbon atoms, at least one of $R_1$, $R_2$ and $R_3$ having a hydroxyl group, with (ii) a saturated or unsaturated fatty acid having 10 to 30 carbon atoms. Preferably, at least one of $R_1$, $R_2$ and $R_3$ is an alkyl group. Preferably, the tertiary amine will have at least one hydroxyalkyl group having 2 to 4 carbon atoms. The ester may be a mono-, di- or tri-ester or a mixture thereof, depending on how many hydroxyl groups are available for esterification with the acyl group of the fatty acid. A preferred embodiment comprises a mixture of esters formed as the reaction product of (i) a tertiary hydroxy amine of the formula $R_1R_2R_3N$ wherein $R_1$, $R_2$ and $R_3$ may be a $C_2$-$C_4$ hydroxy alkyl group with (ii) a saturated or unsaturated fatty acid having 10 to 30 carbon atoms, with a mixture of esters so formed comprising at least 30-60 wt. %, preferably 45-55 wt. % diester, such as 50 wt. % diester, 10-40 wt. %, preferably 20-30 wt. % monoester, e.g. 25 wt. % monoester, and 10-40 wt. %, preferably 20-70 wt. % triester, such as 25 wt. % triester. Suitably, the ester is a mono-, di- or tri-carboxylic acid ester of triethanolamine and mixtures thereof.

Typically, the total amount of additional organic ashless friction modifier in a lubricant according to the present invention does not exceed 5 mass %, based on the total weight of the lubricating oil composition and preferably does not exceed 2 mass % and more preferably does not exceed 0.5 mass %. In an embodiment of the present invention, the lubricating oil composition contains no additional organic ashless friction modifier.

Viscosity modifiers (VM) function to impart high and low temperature operability to a lubricating oil. The VM used may have that sole function, or may be multifunctional. Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Anti-oxidants, sometimes referred to as oxidation inhibitors, increase the resistance of the composition to oxidation and may work by combining with and modifying peroxides to render them harmless, by decomposing peroxides, or by rendering oxidation catalysts inert. Oxidative deterioration can be evidenced by sludge in the lubricant, varnish-like deposits on the metal surfaces, and by viscosity growth.

Examples of suitable antioxidants are selected from copper-containing antioxidants, sulfur-containing antioxidants, aromatic amine-containing antioxidants, hindered phenolic antioxidants, dithiophosphates derivatives, and metal thiocarbamates. Preferred anti-oxidants are aromatic amine-containing antioxidants, hindered phenolic antioxidants and mixtures thereof. In a preferred embodiment, an antioxidant is present in a lubricating oil composition of the present invention.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1, 3, 4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient or elevated temperatures.

Preferably, all the additives except for the viscosity modifier and the pour point depressant are blended into a concentrate or additive package described herein as the additive package that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20, preferably 4 to 18, and most preferably 5 to 17, mass % of the concentrate or additive package with the remainder being base stock.

Typically, a lubricating oil composition according to the present invention contains up to 0.4, more preferably up to 0.3, most preferably up to 0.2, mass % sulfur, based on the total mass of the composition and as measured according to ASTM method D4927. In an embodiment of the present invention, a lubricating oil composition according to the second aspect of the invention does not comprise 0.2-0.25 mass % of sulphur as measured according to ASTM method D4927.

A lubricating oil composition according to the present invention contains up to and including 1.2 mass %, preferably up to 1.1 mass %, even more preferably up to 1.0 mass % sulphated ash.

Typically, a lubricating oil composition according to the present invention contains up to 0.30, more preferably up to 0.20, most preferably up to 0.15, mass nitrogen, based on the total mass of the composition and as measured according to ASTM method D5291. In an embodiment of the present invention, a lubricating oil composition according to the second aspect of the invention does not comprise 0.08-0.11 mass % of nitrogen as measured according to ASTM method D5291.

Typically, the additive package used to formulate the lubricating oil composition according to the present invention has a total base number (TBN) as measured by ASTM D2896 of 25 to 100, preferably 45 to 80, and the lubricating oil composition according to the present invention has a total base number (TBN) as measured by ASTM D2896 of 4 to 15, preferably 5 to 12. In an embodiment of the present invention, the additive package does not have a total base number (TBN) as measured by ASTM D2896 of between 62 and 63.5 and the lubricating oil composition does not have a total base number (TBN) as measured by ASTM D2896 of between 9.05 and 9.27.

Preferably, the lubricating oil composition is a multigrade identified by the viscometric descriptor SAE 20WX, SAE 15WX, SAE 10WX, SAE 5WX or SAE 0WX, where X represents any one of 20, 30, 40 and 50; the characteristics of the different viscometric grades can be found in the SAE J300 classification. In an embodiment of each aspect of the invention, independently of the other embodiments, the lubricating oil composition is in the form of an SAE 10WX, SAE 5WX or SAE 0WX, preferably in the form of an SAE 5WX or SAE 0WX, wherein X represents any one of 20, 30, 40 and 50. Preferably X is 20 or 30.

EXAMPLES

The invention will now be described in the following examples which are not intended to limit the scope of the claims hereof.

Lubricating Oil Compositions

Six oil samples were prepared according to the Table 1. The quantities given are on an active matter basis.

TABLE 1

| Component | Oil 1 Mass % | Oil 2 Mass % | Oil 3 Mass % | Oil 4 Mass % | Oil 5 Mass % | Oil 6 Mass % |
|---|---|---|---|---|---|---|
| Base oil[1] | 100 | 99.75 | 99.18 | 99.64 | 99.39 | 99.39 |
| B1 Friction Modifier[2] | — | 0.25 | 0.72 | — | — | 0.25 |
| B2 Molybdenum Compound[3] | — | — | — | 0.36 | 0.61 | 0.36 |

[1]The base oil was SN150 Group I base stock.

[2]The friction modifier was a compound as described in WO 2011/107739

[3]The molybdenum compound was a molybdenum dithiocarbamate, available from Infineum UK Ltd.

Testing and Results

A high frequency reciprocating rig (HFRR) was used to evaluate the friction characteristics of Oils 1 to 6. The rig was set up with a 6 mm ball on a 10 mm disc. The test protocol employed was as follows:

| | |
|---|---|
| Test Duration (mins) | 60 |
| Test Load (N) | 4 |
| Frequency (Hz) | 20 |
| Stroke Length (microns) | 1,000 |
| Temperature (C.) | 60 |

The results are set out in Table 2 and represent the initial friction (1 second) and friction once equilibrium has been reached (1501 seconds).

Oil 1 is an unmodified base oil. Oils 2 to 6 contain various friction modifier and or molybdenum additive combinations. In order to illustrate the effect of the friction modifier and molybdenum additive, no other additives were present in the Oils 2 to 6.

It can be seen from the results in Table 2 and FIG. 1, that the unmodified base stock has a fairly constant friction coefficient. Oils 2 and 3, containing only the friction modifier B1, show some improvement in friction coefficient compared to the unmodified base oil, but there is no significant difference between the two different treat rates. Looking at the effect of the molybdenum additive B2, the benefits of molybdenum at the lower treat rate of Oil 4 is variable and is not sustained over a longer period. At the higher treat rate of Oil 5, there is some improvement in friction coefficient.

Looking now at Oil 6 with its combination of friction modifier B1 and molybdenum compound B2, it can be seen that there is a synergistic effect produced from this combination. The data in Table 2 clearly shows that this combination effects a significant reduction in friction coefficient compared to the oils containing only one of these additives at either the lower or higher treat rates. This significant reduction in friction coefficient cannot be expected from the performance of the individual additives and is significantly more than a cumulative benefit of the two additives. Such a significant reduction in friction coefficient will be beneficial in obtaining improved fuel economy performance.

TABLE 2

| Time (s) | Oil 1 | Oil 2 | Oil 3 | Oil 4 | Oil 5 | Oil 6 |
|---|---|---|---|---|---|---|
| 1 | 0.004 | 0.003 | 0.004 | 0.003 | 0.004 | 0.003 |
| 1501 | 0.153 | 0.145 | 0.14 | 0.141 | 0.133 | 0.106 |
| 1801 | 0.155 | 0.138 | 0.143 | 0.141 | 0.135 | 0.067 |
| 2101 | 0.159 | 0.138 | 0.144 | 0.144 | 0.137 | 0.066 |
| 2401 | 0.156 | 0.142 | 0.142 | 0.145 | 0.137 | 0.07 |
| 2701 | 0.158 | 0.14 | 0.147 | 0.15 | 0.139 | 0.071 |
| 3001 | 0.155 | 0.145 | 0.145 | 0.157 | 0.136 | 0.073 |
| 3301 | 0.154 | 0.145 | 0.144 | 0.163 | 0.135 | 0.073 |
| 3596 | 0.156 | 0.146 | 0.145 | 0.169 | 0.13 | 0.072 |

What is claimed is:

1. An internal combustion engine crankcase lubricating oil composition having a sulphated ash content of no greater than 1.2 mass %, based on the mass of the lubricating oil composition, and a phosphorous content of no greater than 1200 ppm, based on the mass of the lubricating oil composition, which lubricating oil composition comprises or is made by admixing:

(A) a crankcase base oil of lubricating viscosity, in a major amount; and (B) the following additives:

(B1) from about 0.2 to about 1.5 mass %, based on the total mass of the lubricating oil composition, of a polymeric friction modifier being the reaction product of (a) polyisobutene functionalized with a diacid or anhydride functional group, (b) a polymer of a water soluble alkylene glycol selected from the group consisting of polyethylene glycol, poly(ethylene-propylene) glycol, and poly (ethylene-butylene) glycol, (c) a polyol, and (d) a monocarboxylic acid chain terminating group (B2) at least one oil-soluble molybdenum compound in an amount introducing from about 200 to about 500 ppm of molybdenum into the lubricating oil composition.

2. A composition as claimed in claim 1, wherein the polyether is polyethylene glycol (PEG) selected from $PEG_{400}$, $PEG_{600}$, $PEG_{1000}$ or mixtures thereof.

3. A composition as claimed in claim 1, wherein the polyisobutene is functionalised by reaction with maleic anhydride.

4. A composition as claimed in claim 1, wherein the polyol is glycerol.

5. A composition as claimed in claim 1, wherein the oil soluble molybdenum compounds is chosen from the group comprising molybdenum salts of dithiocarbamates, dithiophosphates, dithiophosphinates, xanthates, thioxanthates, sulfides, or a mixtures thereof.

6. A composition as claimed in claim 5, wherein the oil soluble molybdenum compounds is chosen from the group comprising molybdenum salts of dithiocarbamates, dialkyldithiophosphates, alkyl xanthates, alkylthioxanthates and mixtures thereof.

7. A composition as claimed in claim 1, wherein the oil soluble molybdenum compounds, is a mono-, di-, tri- or tetra-nuclear molybdenum compound.

8. A composition as claimed in claim 6, wherein the oil soluble molybdenum compounds, is a dinuclear or trinuclear molybdenum compound.

9. A composition as claimed in claim 8, wherein the oil soluble molybdenum compound is a trinuclear molybdenum compounds.

10. A method of improving fuel economy performance of a vehicle, which method comprises the step of lubricating the engine with a lubricating oil composition according to claim 1.

* * * * *